US005583944A

United States Patent [19]

Morohoshi et al.

[11] Patent Number: 5,583,944

[45] Date of Patent: Dec. 10, 1996

[54] SPEAKER

[75] Inventors: Yukinori Morohoshi; Yoshinobu Sengiku; Asahiko Okada, all of Matsusaka; Teru Kawahara; Manabu Muraoka, both of Tsu; Eiichi Morimoto, Matsusaka; Ryoui Hamaguchi, Taki-gun, all of Japan

[73] Assignee: Matsushita Electric Industrial Co., Ltd., Osaka, Japan

[21] Appl. No.: 430,870

[22] Filed: Apr. 28, 1995

Related U.S. Application Data

[63] Continuation of Ser. No. 144,805, Oct. 28, 1993, abandoned.

[30] Foreign Application Priority Data

Oct. 28, 1992 [JP] Japan ..... 4-289875

[51] Int. Cl.[6] ..... H04R 25/00

[52] U.S. Cl. ..... 381/194; 381/192

[58] Field of Search ..... 381/192, 194, 381/195, 197, 199, 188, 205, 117, 59

[56] References Cited

U.S. PATENT DOCUMENTS

| | | | |
|---|---|---|---|
| 2,458,158 | 1/1949 | Gilman | 381/194 |
| 3,006,430 | 10/1961 | Petrie et al. | 381/194 |
| 4,720,868 | 1/1988 | Hirano | 381/182 |
| 4,829,582 | 5/1989 | Heuvinck | 381/194 |
| 5,012,457 | 4/1991 | Mitchell et al. | 367/175 |
| 5,091,958 | 2/1992 | Sakamoto et al. | 381/194 |

FOREIGN PATENT DOCUMENTS 146596 6/1988 Japan .

*Primary Examiner*—Curtis Kuntz
*Assistant Examiner*—Huyen Le
*Attorney, Agent, or Firm*—Ratner & Prestia

[57] ABSTRACT

A speaker having a diaphragm with an outer peripheral part. A voice coil is disposed within and coupled to the diaphragm, the voice coil supported by a voice coil bobbin with the voice coil having at least two lead wires. The speaker includes a generally cup-shaped frame with the diaphragm disposed inside of the frame so that an outer peripheral part of the diaphragm is coupled to the frame with a damper disposed inside of the cup-shaped frame so that adhesive on the outer part of the damper is used to adhere the damper to the frame. The speaker is completed with an electric relay terminal coupled to the lead wires of the voice coil, a terminal base coupled to the frame, at least two electric connection terminals coupled to the terminal base, one end of each electric connection terminal projecting inside of the space defined by the cup-shaped frame and coupled to the electric relay terminal at a position above a central part of the damper with the lead wires extending the shortest distance between the voice coil and the electric connection terminals projecting inside the frame so that low frequency resonance is avoided when the speaker is in use.

7 Claims, 9 Drawing Sheets

SPEAKER

This application is a continuation of U.S. patent application Ser. No. 08/144,805 filed Oct. 28, 1993, now abandoned.

FIELD OF THE INVENTION

The present invention relates to a speaker used in various audio appliances such as radio receiver, television receiver, and stereo set.

BACKGROUND OF THE INVENTION

A conventional speaker is structured as shown in FIG. 17 and FIG. 18. That is, a magnetic circuit forming a narrow annular magnetic gap 12 between a ring-shaped upper plate 2 and center pole part of a lower plate 3 is composed of a permanent magnet 1 and magnetic material, and a frame 10 holding a diaphragm 8 is fixed on the upper surface of the magnetic circuit. A voice coil 4 for driving a diaphragm is placed in the magnetic gap, and it is supported by a damper 5 so as not to contact with the circumference. A lead wire 6 of the voice coil is a flexible wire so as to withstand repetitive flexures by vibration of the voice coil, and it is connected to an electric connection terminal 7 fixed on the frame 10 as shown in FIG. 17. This connection is called direct connection.

By indirect connection, on the other hand, the end of the voice coil is drawn out onto the upper surface of the diaphragm as shown in FIG. 18, and is connected to the flexible wire 6 of which one end is fixed to the diaphragm 8 on the upper surface of the diaphragm.

The lead wire connection in the conventional voice coil involved the following problems.

(1) In the indirect connection shown in FIG. 18, it requires the skill of passing the end of the flexible wire 6 into the hole in the electric connection terminal 7 and mounting the diaphragm 8 on the frame at the same time. The flexible wire 6 is connected by soldering to the electric connection terminal 7 with a certain sag so as not to interfere the vibration of the voice coil. The speaker is assembled with the frame 10 directed upward, but this soldering connection only is done with the frame 10 set downward, from the outside of the frame, and therefore this process is not preferable for automation of the manufacture.

(2) In the direct connection in FIG. 17, the vibration of the voice coil 4 is directly transmitted to the flexible wire 6. When this vibration is transmitted to the solder connection part of the electric connection terminal 7, the flexible wire 6 may be broken at this point, and therefore solder connection of the electric terminal 7 and flexible wire 6 is down from the outside of the frame with the frame 10 set downward. This process is, as mentioned above, not favorable for automation of the manufacture. Besides, so as not to interfere the vibration of the voice coil, the flexible wire 6 is connected by soldering to the electric terminal 7 with a certain sag, and the sag is manually formed into a specific shape so that the sag may not contact with the diaphragm 8 and the damper 5.

(3) The flexible wire 6 of direct connection is longer than that of indirect connection, and therefore the mass is greater and the treble characteristic of the speaker is poor. Besides, the long flexible wire 6 is likely to vibrate at large amplitude known as rope skipping phenomenon. Once rope skipping occurs, the flexible wire 6 contacts with the diaphragm 8 or damper 5 to cause unusual sound, and fatigue due to flexure is accelerated to lead to wire breakage in a short time. If the flexible wire 6 is increased in thickness and heightened in rigidity in order to suppress rope skipping, the mass increases, and the treble characteristic of the speaker is further worsened. If the flexible wire 6 is much thicker, as shown in FIG. 17, the voice coil bobbin 4*a* is extended in length for the increment of the thickness of the flexible wire 6, and therefore the attenuation of high frequency vibration propagated to the diaphragm 8 is increased, which also causes deterioration of treble characteristic. In addition, since the height of the speaker is generally limited, the diaphragm 8 is flattened by the portion of increment of the length of the voice coil bobbin 4*a*, which also causes to worsen the treble characteristic.

SUMMARY OF THE INVENTION

The present invention relates to a speaker possessing high performance and high reliability. In a preferred embodiment of the invention, the speaker comprises a diaphragm, a magnetic circuit forming a magnetic gap, a frame fixed on the upper surface of the magnetic circuit, said frame accommodating a diaphragm in its inside and fixing an outer peripheral part of the diaphragm on the outer peripheral part, a voice coil fixed in the center of the diaphragm and inserted in the magnetic gap, possessing two lead wires, an electric relay terminal connected to the front ends of the individual lead wires of the voice coil, and an electric connection terminal connected to the electric relay terminal through one end projecting inside of the frame toward the inner direction of the frame fixed on the frame respectively. The invention will be further understood and appreciated from the following detailed description taken in conjunction with the drawings.

BRIEF DESCRIPTION OF THE DRAWINGS

FIG. 1(*b*) is a magnified sectional view of an electric connection terminal used in FIG. 1.

FIG. 13(*b*) shows a hole for fixing the electric connection terminal provided on the frame in the fourth embodiment of the invention.

DESCRIPTION OF THE PREFERRED EMBODIMENTS

First Embodiment

Figure 1A:
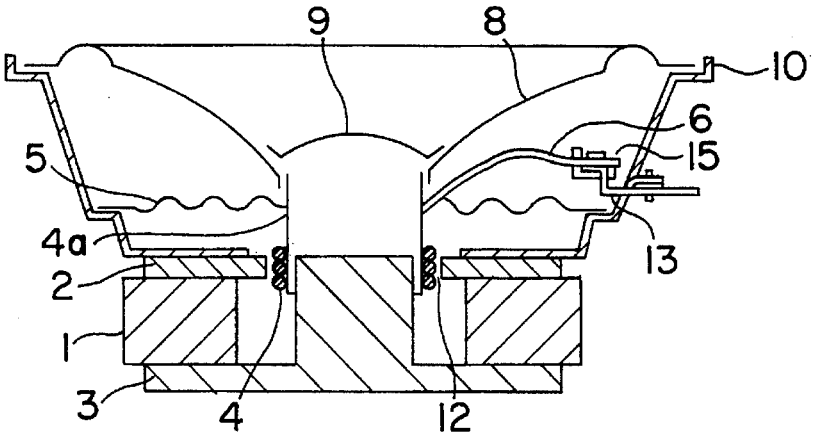
FIG. 1(*a*) is a sectional view showing the structure of a speaker according to a first embodiment of the invention.
Figure 1B:
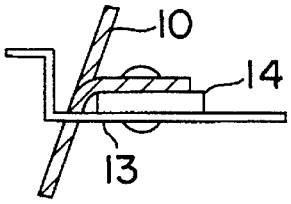
Figure 2:
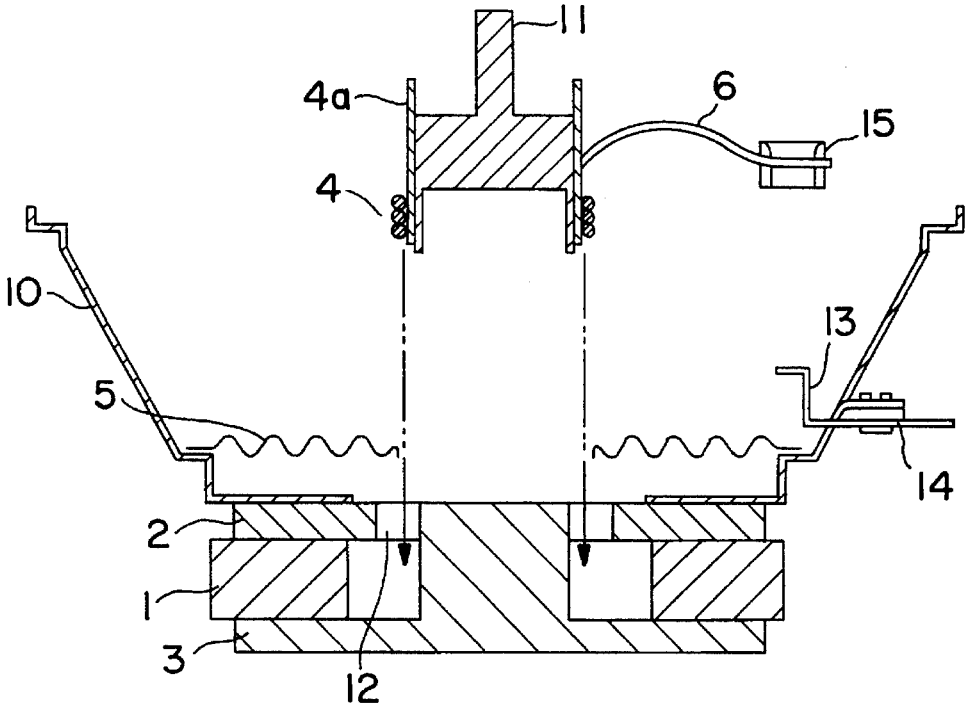
FIG. 2 is an exploded sectional view of principal constituent elements in FIG. 1.

Referring to FIG. 1 to FIG. 5, the speaker in the first embodiment of the invention is described below. FIG. 1(*a*) is a sectional view showing the structure of the speaker in the embodiment, FIG. 1(*b*) is a sectional view magnifying the electric connection terminal, and FIG. 2 is an exploded sectional view for explaining the manufacturing method of the speaker.

In FIG. 1 and FIG. 2, a magnetic circuit composed of a ring-shaped magnet 1, a ring-shaped upper plate 2, and a lower plate 3 having a center pole holds the magnet 1 between the upper plate 2 and lower plate 8, and forms a narrow annular magnetic gap 12 between the upper plate 2 and center pole of the lower plate 3. A frame 10 is fixed on the upper surface of upper plate 2 of this magnetic circuit.

A voice coil 4 is inserted into the magnetic gap 12, and is supported by a damper 5 so as not to be in contact with the surroundings. A diaphragm 8 has a voice coil bobbin 4*a* fixed in the center, and the outer peripheral part is fixed to the outer peripheral part of the frame 10, and is accommodated in the frame. A dust cap 9 prevents dust from invading into the surroundings of the voice coil bobbin 4*a* from outside. A terminal base 14 made of an insulating material is fixed to the frame 10. Two electric connection terminals 13 made of conductive material are fixed to the terminal base 14. One end of each electric connection terminal 13 is projecting inside of the frame 10 through a window hole, and the one end projecting inside is connected to an electric relay terminal 15 connected to two flexible wires 6 which are lead wires of the voice coil 4. The other end of each electric connection terminal 13 is connected to a signal wire from an audio appliance at the outside of the frame 10.

Figure 3:
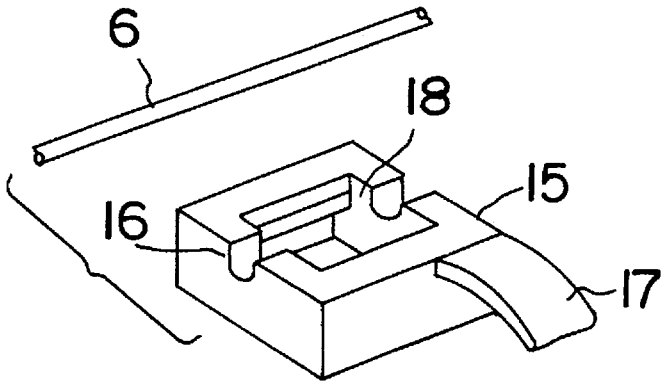
FIG. 3 is a perspective view of an electric relay terminal used in FIG. 1.

An example of electric relay terminal 15 is shown in FIG. 3. The flexible wire 6 is inserted into a slit 16, and the electric relay terminal 15 and flexible wire 6 are connected. In the center, there is a hollow part 18 penetrating in the vertical direction.

Figure 4:
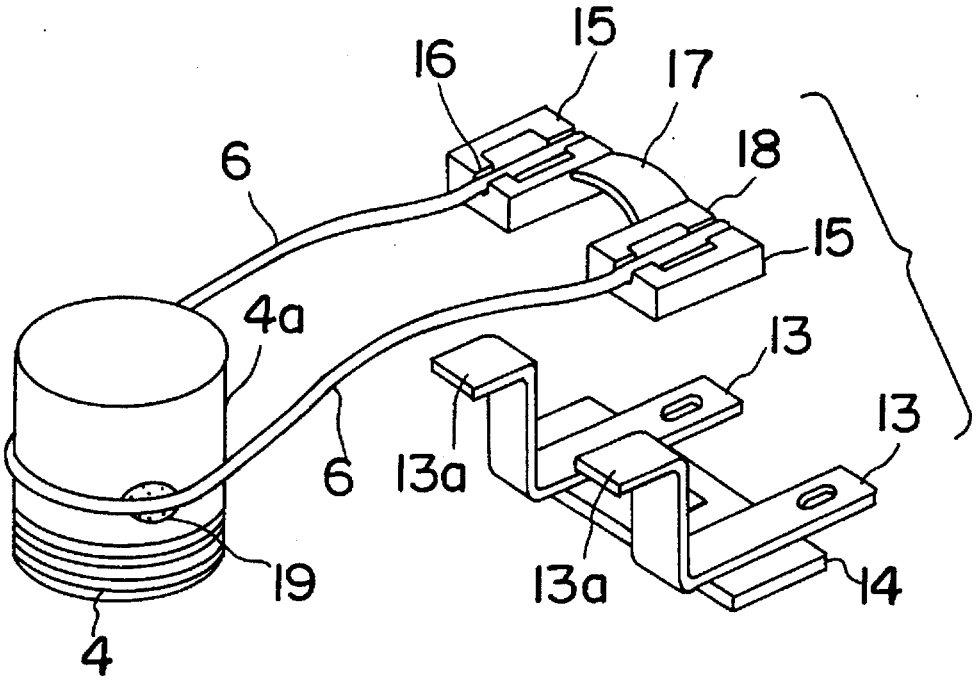
FIG. 4 is a perspective view of a voice coil fitting the electric relay terminal used in FIG. 1, and the electric connection terminal connected with this electric relay terminal.

FIG. 4 shows the voice coil 4 possessing the electric relay terminal 15 and the electric connection terminal 13. In order improve the working efficiency, two electric relay terminals 15 are coupled with an insulator 17.

As the folded front end 13*a* of the electric connection terminal is inserted tightly into the hollow part 18 provided in the electric relay terminal 15, the both can be connected easily.

Furthermore, the front end 13*a* of the electric connection terminal is inserted into the hollow part 18 of the electric relay terminal, and is electrically connected in contact with the flexible wire 6, and when the front end 13*a* of the electric connection terminal and the electric relay terminal 15 are soldered and bonded firmly in this state, a higher reliability of connection is achieved.

The flexible wire 6 must have a proper sag so as not to interfere the vibration of the voice coil 4. When connecting the flexible wire 6 and the electric relay terminal 15, by determining the length of the flexible wire 6 in consideration of the length of sag, a speaker of uniform quality is manufactured.

The speaker of the invention is completed, as shown in FIG. 2, by fixing the frame 10 to the upper surface of the magnetic circuit possessing a magnetic gap 12, inserting the voice coil 4 connecting the electric relay terminal 15 into the magnetic gap 12, connecting the electric relay terminal 15 to the electric connection terminal 13, fixing the damper 5 for supporting the voice coil 4 to the frame 10, and inserting the diaphragm 8 and dust cap 9 from above.

Numeral 11 is a gauge for Inserting the voice coil 4 into the magnetic gap 12 without eccentricity. In this assembling process, all members are supplied from above, and there is no step of turning the speaker upside down, so that the manufacture may be automated easily.

The speaker of the invention improves the defects of the conventional speaker caused by increase of the mass by thickening the flexible wire in order to prevent resonance at low wave number, that is, rope skipping, and flattening of the diaphragm for the portion of increment of the thickness of flexible wire, and lowering of the treble characteristic. That is, in the speaker of the invention, since the connection of the electric connection terminal 13 and flexible wire 6 is done inside of the frame 10, and therefore the length of the flexible wire is shorter than in the conventional structure, and the resonance frequency is a high frequency, so that resonance does not occur at low wave number.

When the flexible wire 6 resonates at low frequency, the amplitude is large, and in order to avoid contact of the flexible wire 6 with the damper 5 and diaphragm 8 at the time of resonance, the clearances of flexible wire 6 and damper 5, and flexible wire 6 and diaphragm 8 must be set larger. It results in an addition to the height of the speaker, which is inconvenient. To avoid such inconvenience, it is effective to shorten the length of the flexible wire, heighten the resonance frequency, and reduce the amplitude in resonance as in the invention.

Figure 5:
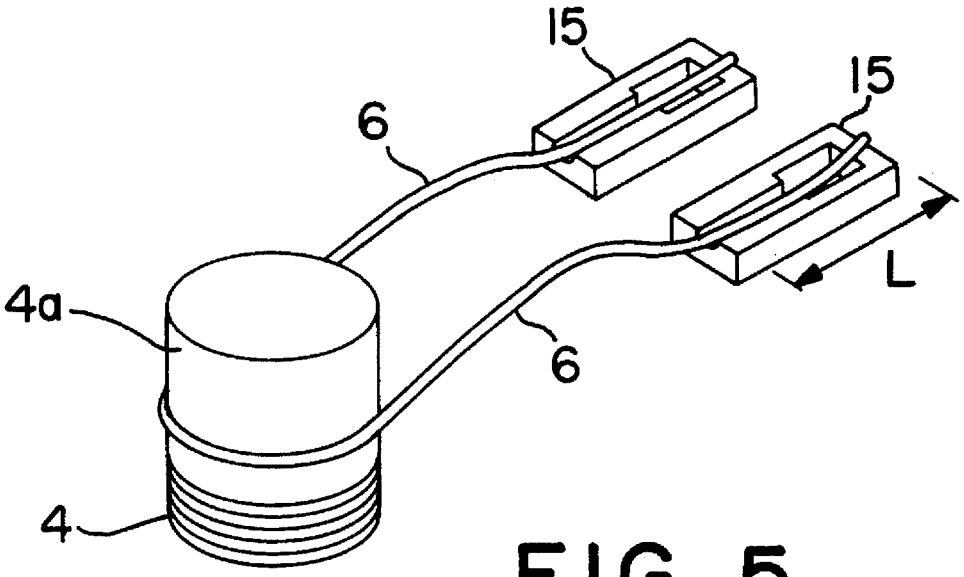
FIG. 5 is a perspective view of other example of electric relay terminal used in FIG. 1.

As shown in FIG. 5, the length of the flexible wire 6 can be shortened by extending the length L of the electric relay terminal 15. As a result, even by using a thin, lightweight flexible wire, resonance does not occur in the low frequency band which is the large amplitude region for the speaker, and since the flexible wire moves completely as one body together with the diaphragm, and therefore unusual sound does not occur due to contact of the flexible wire with the diaphragm or damper.

The speaker of the invention is short in length and small in mass of the flexible wire 6, resonance of larger amplitude as experienced conventionally does not occur, and moreover since the wire diameter is small, the clearance between the damper 5 and the diaphragm 8 in the part through which the flexible wire runs through can be narrowed, so that the overall height of the speaker can be lowered, and the length of the voice coil bobbin 4*a* can be shortened, which causes to decrease the propagation attenuation, so that the treble characteristic is improved. Of course, in the short flexible wire 6, disconnection due to vibration hardly occurs as compared with the prior art.

Second Embodiment

Figure 6:
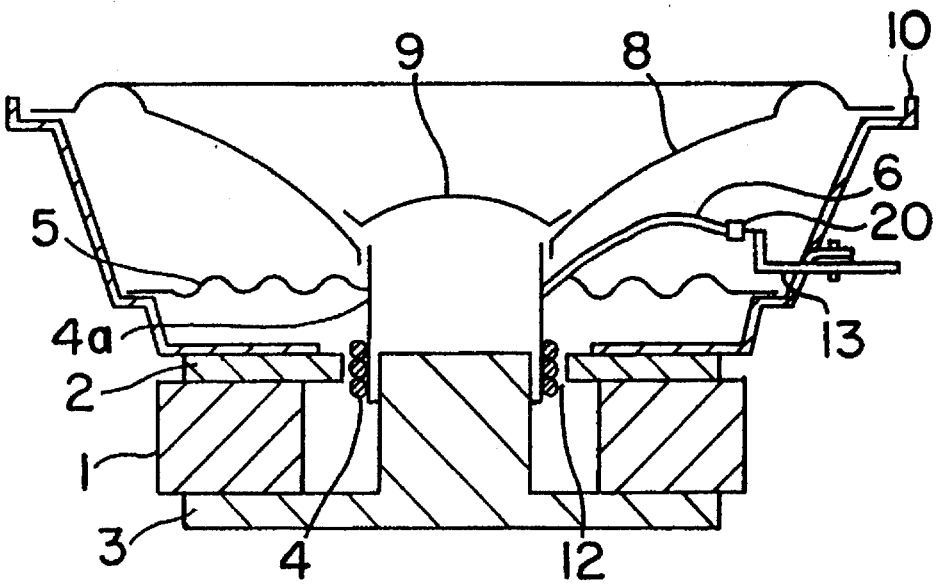
FIG. 6 is a sectional view showing the structure of a speaker in a second embodiment of the invention.
Figure 7:
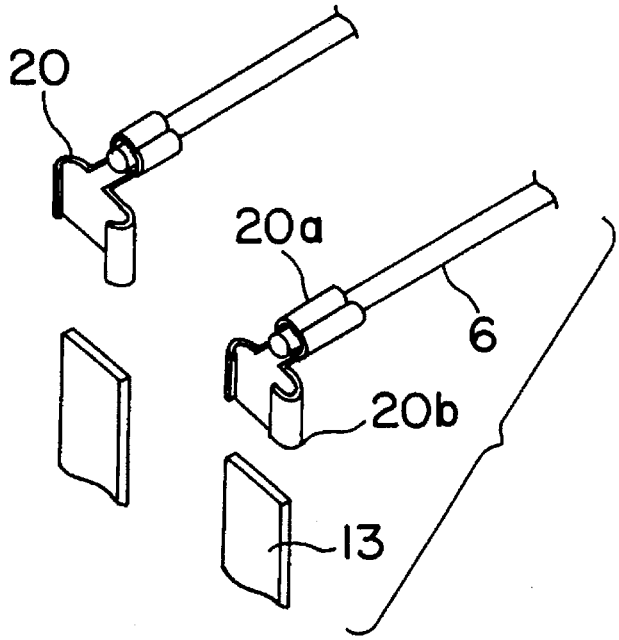
FIG. 7 is a perspective view showing the connection of lead wire of voice coil and electric connection terminal executed in the second embodiment.

Referring next to FIGS. 6 and 7, the second embodiment of the invention is described. What differs from the first embodiment is the structure and material of an electric relay terminal 20. More specifically, the relay terminal 20 is made from a metal plate, and possesses junction 20*a* to be crimped and joined to the front end portion of the flexible wire 6 drawn out from the voice coil 4 at one end as shown in FIG. 7, and also possesses a fitting part 20*b* to be fitted to the front end of the electric connection terminal 13 fixed to the frame 10 at the other end.

The electric connection terminal 13 is inserted into the fitting part 20*b* and the both are electrically connected, and the connection may be reinforced, if necessary, by soldering, crimping or the like.

When two electric relay terminals 20 are separate as shown in FIG. 7, twisting of the flexible wire 6 is likely to occur, and it is hard to automate the work, and therefore it is possible to use the structure of two coupled pieces, and separate after connecting to the electric connection terminal 13. Of course, if the two electric relay terminals 20 are coupled with an insulating resin material, it is not necessary to cut off.

Third Embodiment

Figure 8:
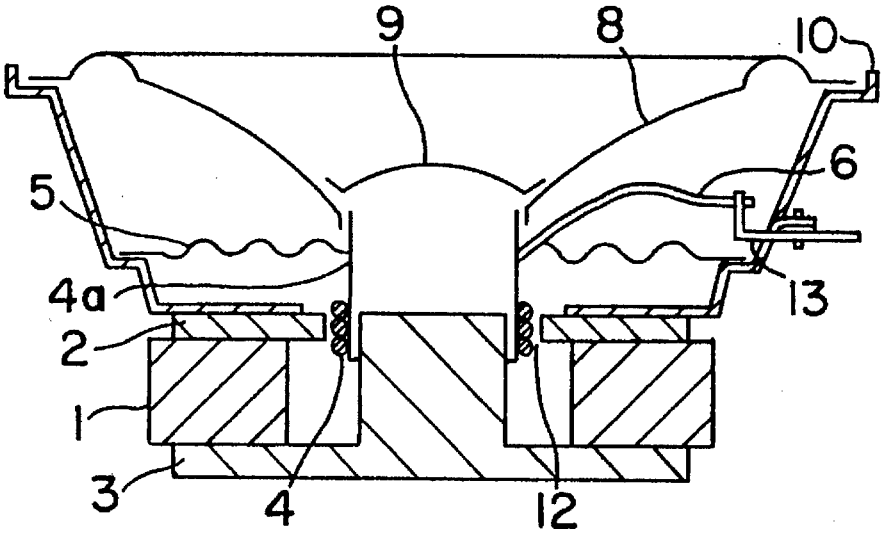
FIG. 8 is a sectional view showing the structure of a speaker according to a third embodiment of the invention.
Figure 9:
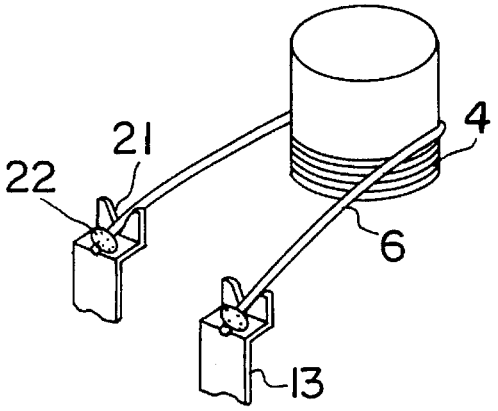
FIG. 9 is a perspective view showing the connection of flexible wire and electric connection terminal executed in the third embodiment.
Figure 10:
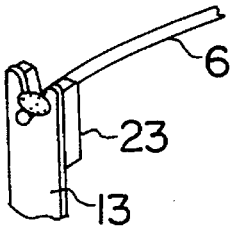
FIG. 10 is a perspective view showing other example of connection of flexible wire and electric connection terminal executed in the third embodiment.

Referring now to FIGS. 8, 9 and 10, the third embodiment of the invention is described. The same constituent elements as in the first and second embodiments are identified with same reference numbers, and their explanations are omitted. Between the third embodiment and the foregoing first and second embodiments, the connection of flexible wire 6 and electric connection terminal is different. In the third embodiment, the electric relay terminal is not used. That is, as shown in FIG. 9, the flexible wire 6 is inserted into a slit 21 formed in the front end of the electric connection terminal 13, and the inserted part is crimped and fixed. Or, in other method, by inserting the flexible wire 6 tightly into the slit 21 finished in a slightly smaller dimension, the flexible wire 6 is fixed to the electric connection terminal 13, and the both are connected by soldering in a folded part 22. Thus, the force for vibrating the flexible wire 6 is prevented from reaching up to the soldered part, so that the possibility of wire disconnection can be lowered.

Or, as shown in FIG. 10, when the flexible wire 6 is supported by the slit in a plate form insulation piece 23 of about 1 mm in thickness fixed to the front end of the electric connection terminal 13, the solder for connecting the electric connection terminal 13 and the flexible wire 6 does not flow into the portion enclosed by the insulation piece 23, and the force for vibrating the flexible wire does not propagate to the soldered part, so that the risk of wire disconnection is lowered same as in the structure shown in FIG. 9.

Forth Embodiment

Figure 11:
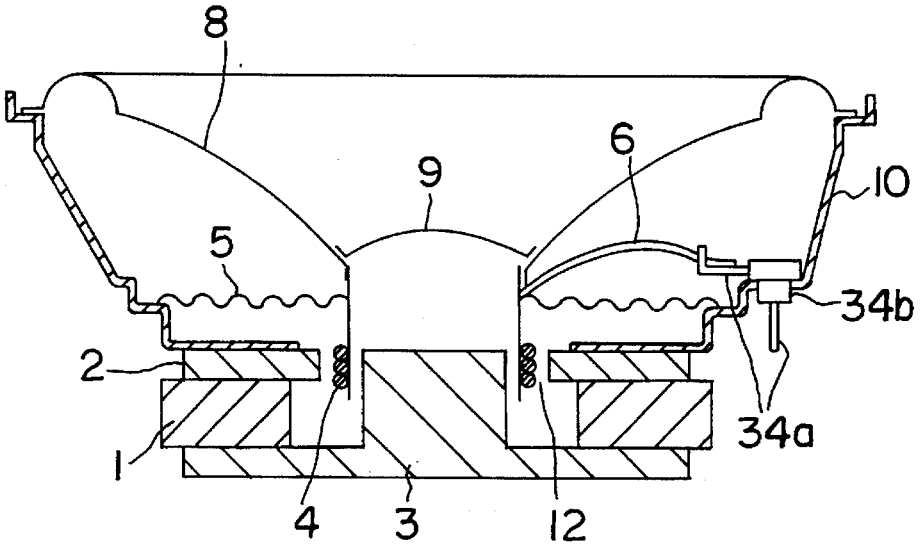
FIG. 11 is a sectional view showing the structure of a speaker according to a fourth embodiment of the invention.

FIG. 11 shows a fourth embodiment. The same constituent elements as those described hitherto are Identified with same reference numerals and their repeated description is omitted.

A terminal base 34*b* is fixed to a surface of the flat portion inside of the frame 10 and outside from the outer periphery of the damper 5. The terminal base 34*b* fixed surface is nearly parallel to the front surface of the speaker, that is, the surface including the outer periphery of the frame 10.

As seen from the front side of the speaker, the terminal base 34*b* is inside of the frame 10 and outside from the outer periphery of the damper 5, but an electric connection terminal 34*a* is connected to a lead wire 6 of the voice coil at a position inside of the outer periphery of the damper 5 through an end projecting inside of the frame toward the inside direction of the frame 10. When the length of the electric connection terminal 34*a* is extended, the lead wire 6 of the voice coil may be shortened, and the same effect as in the foregoing embodiments will be obtained.

Figure 12:
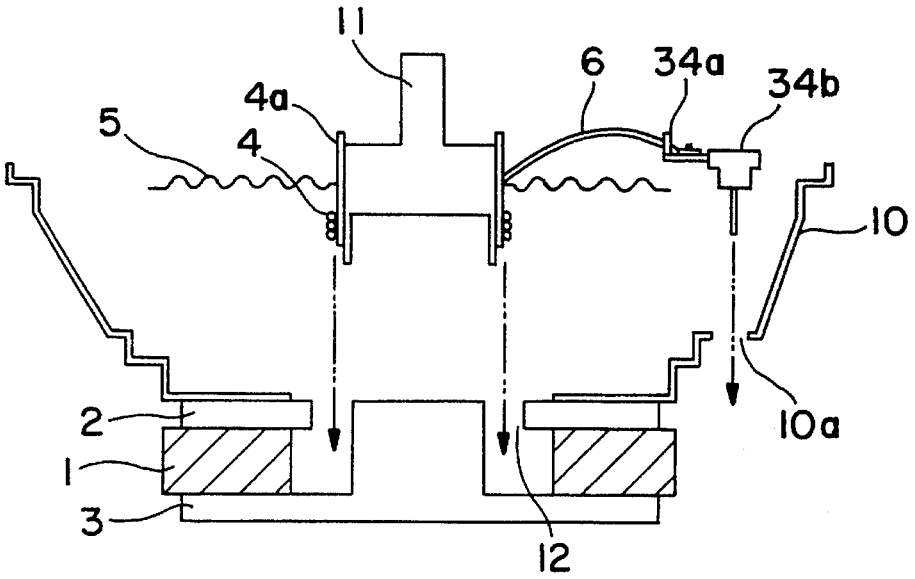
FIG. 12 is a sectional view showing the assembling method of the speaker according to the fourth embodiment of the invention.

FIG. 12 shows the manufacturing method of the speaker shown in FIG. 11. First, the voice coil 4 fixed in the center of the damper 5 is inserted into a magnetic gap 12 while positioning by a gauge 11, and the outer periphery of the damper 5 is fixed to the frame 10 by adhesive at the same time. The electric connection terminal 34*a* and the lead wire 6 of the voice coil have been already connected in the previous step. The terminal base 34*b* is set in a hole 10*a*, and a diaphragm 8 and a dust cap 9 (not shown) are installed.

Figure 13A:
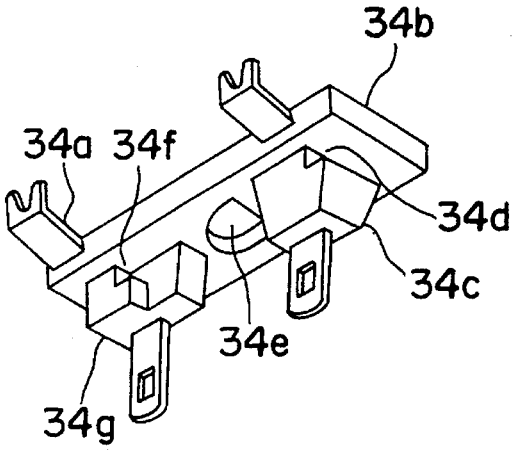
FIG. 13(*a*) is a perspective view of an electric connection terminal used in the fourth embodiment of the invention.
Figure 13B:
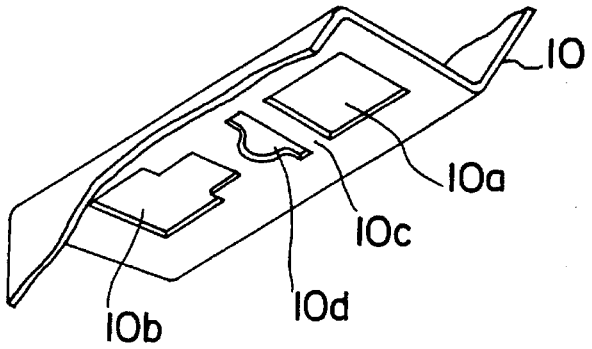
Figure 14A:
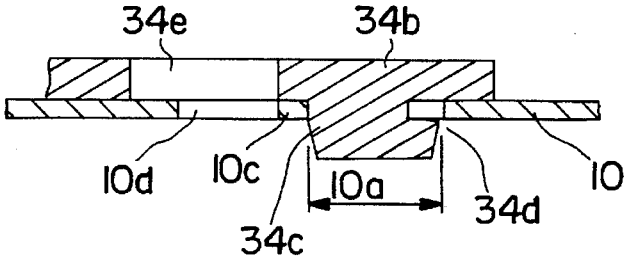
FIGS. 14(*a*) to 14(*e*) show the method of fixing the electric connection terminal used in the fourth embodiment of the invention on the frame.
Figure 14B:
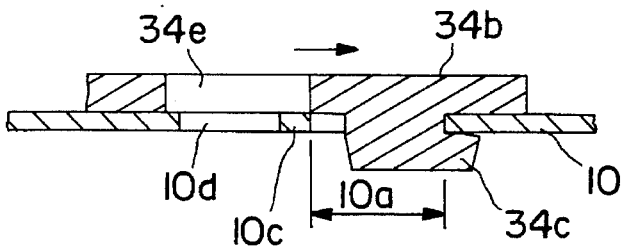
Figure 14C:
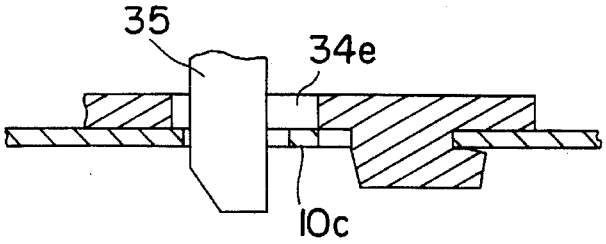
Figure 14D:
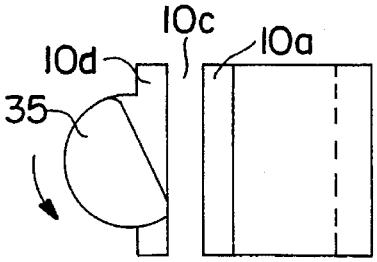
Figure 14E:
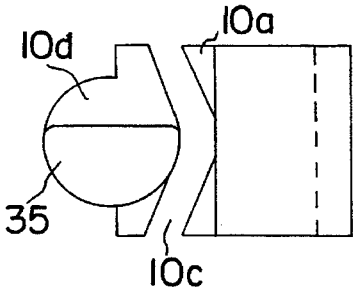

FIG. 13(*a*) shows the terminal base 34*b*, and FIG. 13(*b*) shows the hole 10*a* for fixing the terminal base 34*b* provided on the frame 10.

The terminal base 34*b* possesses protrusions 34*c*, 34*g*, and a hole 34*e*. The protrusion 34*c* possesses a slot 34*d*, to which the electric connection terminal 34*a* is fixed. The protrusion 34*g* possesses a slot 34*f*, to which a terminal lug 34*a* is fixed. The width of the slots 34*d*, 34*f* is equal to the thickness of the iron plate for composing the frame 10.

The frame 10 possesses holes 10*a* and 10*b* for fixing the terminal base, and a hole 10*d* for inserting a tool including a semicircular part at the position corresponding to the hole 34*e* of the terminal base. Between the holes 10*a* and 10*d*, a slender portion 10*c* of iron plate for composing the frame 10 is formed.

FIGS. 14(*a*) to 14(*e*) show the method of fixing the terminal base 34*b* to the frame. That is, the method of fixing the protrusion 34*c* of the terminal base into the hole 10*a* is shown, and although not shown in the drawing for the simplicity of explanation, of course, the protrusion 34*g* of the terminal base is also fixed in the hole 10*b* in the same manner at the same time.

FIG. 14(*a*) is a sectional view of the protrusion 34*c* of the terminal base inserted in the hole 10*a*. When the terminal base 34*b* is moved in the lateral direction along the arrow in FIG. 14(*b*), the iron plate of the frame 10 is tightly and slidably inserted into the slot 34*d*. At the same time, of course, the iron plate of the frame 10 is inserted into the slot 34*f* not shown. As a result, the terminal base 34*b* is fixed to the frame 10 in the vertical direction.

Next, as shown in FIG. 14(*c*) and FIG. 14(*d*), a tool 35 having a semicircular section is inserted into the hole 10*d* for inserting tool. The diameter of the semicircle possessed by the hole 10*d* is large enough so that the semicircle of the section of the tool 35 is inserted by clearance fitting, so that the tool 85 may be rotated in the hole 10*d* as shown in FIG.

14(*d*) and FIG. 14(*e*) while keeping its center almost at the same position. The action point of the force is a slightly central part from the end of the slender portion 10*c* as shown in FIG. 14(*d*) initially, but along with the rotation of the tool 35, while extending the slender portion 10*c* and curving the extended portion by deforming plastically, the action point of the force is moved to the center.

By properly selecting the diameter size of the tool 35, as shown in FIG. 14(*e*), the curved slender portion 10*c* preloads the terminal base, and presses the slot 34*d* of the terminal base tightly to the iron plate of the frame 10 inserted in the slot. As a result, the terminal base 34*b* is fixed to the iron plate of the frame 10.

Figure 15A:
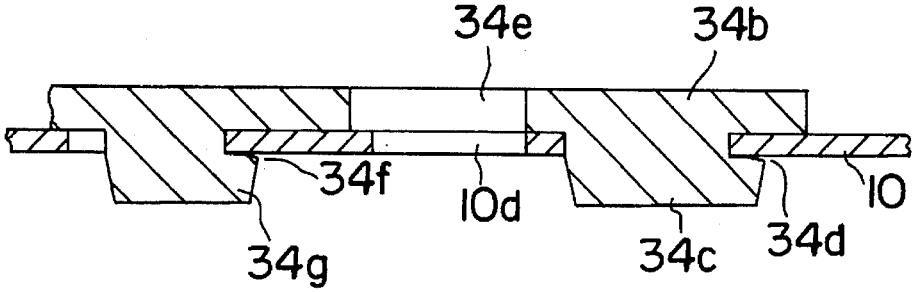
FIGS. 15(*a*), 15(*b*) show the electric connection terminal used in the fourth embodiment of the invention being fixed on the frame.
Figure 15B:
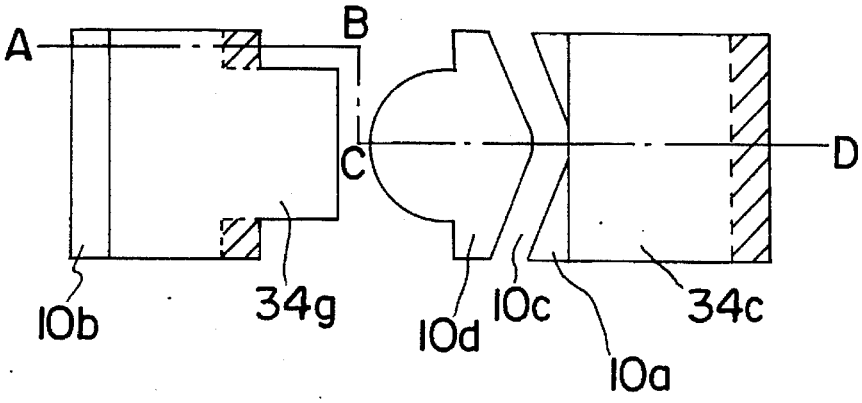

FIG. 15 shows the terminal base 34*b* fixed to the iron plate of the frame 10 by means of slot 34*d* and slot 34*f*. The shaded area in FIG. 15(*b*) is the inserted portion of the iron plate of the frame 10 in the slot. FIG. 15(*a*) is a sectional view along line ABCD in FIG. 15(*b*).

According to our test, the tensile force that the conventional terminal base fixed by eyelet or rivet is usually less than 20 kg. By contrast, the terminal base fixed in the method describe above did not drop out of the iron plate of the frame when pulled with a force of 40 kg.

Besides, this method of fixing the terminal base by plastic deformation of iron plate is less susceptible to adverse effects of temperature, humidity and vibration as compared with the method of making use of elasticity of resin material, so that the reliability is high in long-term use.

Moreover, this method of fixing the terminal base is suited to automatic manufacture because all parts and tools to be used can be inserted from the front side of the speaker while keeping constant the position of the speaker.

The slender portion 10*c* may be broken if the action point of the force to be applied is at an end portion. In the method of the embodiment, the action point of the force moves to the center, along with the rotation of the tool 35, while pulling the slender portion 10*c*, and curving the extended portion by deforming plastically, and the tool 35 moves as being guided by the hole 10*d*, so that the slender frame 10*c* may not be broken or deformed excessively.

Figure 16:
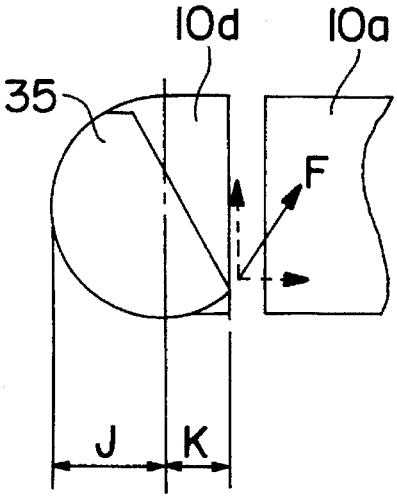
FIG. 16 shows a tool used for fixing the electric connection terminal used in the fourth embodiment of the invention on the frame.
Figure 17:
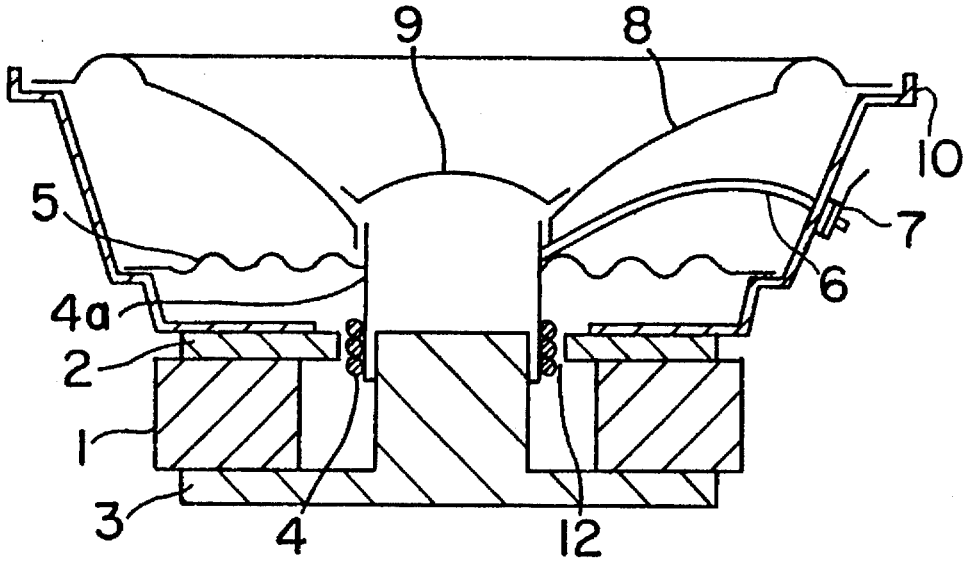
FIG. 17 PRIOR ART
FIG. 17 is a sectional view showing the structure of a speaker of conventional direct connection.
Figure 18:
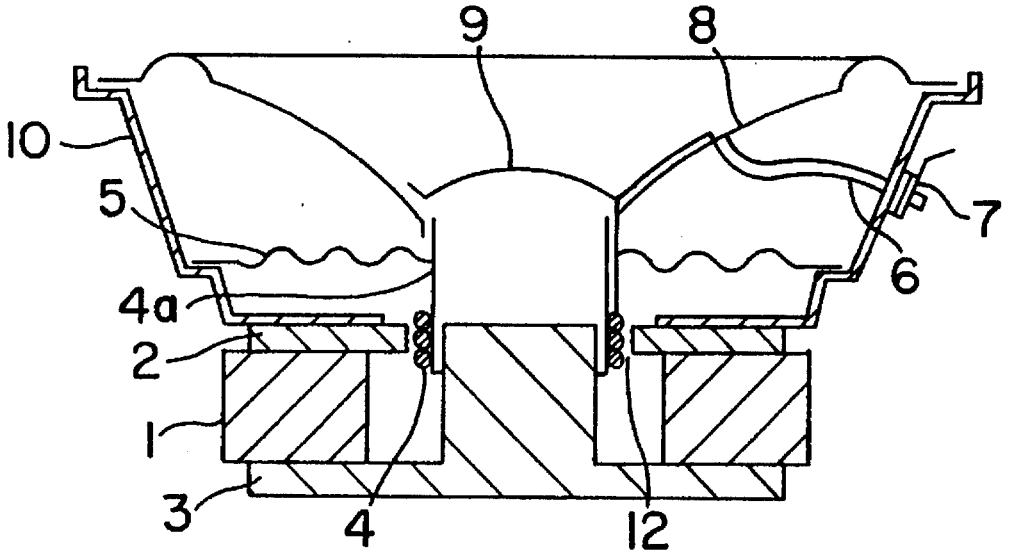
FIG. 18 PRIOR ART
FIG. 18 is a sectional view showing the structure of a speaker of conventional indirect connection.

As shown in FIG. 16, when the hole 10*d* is constituted with the J-portion of the semicircle, and the rectangular K-portion in about half width of the J-portion, the position of action point of force is practically excellent.

The hole 10*d* in FIG. 14(*d*) has its rectangular portion longer than the semicircular portion, and the position of action point of force is further remote from the end portion.

As described herein, the speaker of the invention provides many excellent effects as follows.

(1) The length of the flexible wire may be appropriately determined in the preparation process, so that the assembling job may be easy.

(2) It is easy to automate the assembling job.

(3) The flexible wire is short, thin and light, and it does not resonate in low frequency region, but moves together with the diaphragm in one body, so that unusual noise caused by contact of the flexible wire with diaphragm and damper does not occur.

(4) The force for vibrating the flexible wire does not reach up to the solder connection part structurally, so that wire disconnection occurs hardly.

(5) Using lightweight, thin flexible wire, the small is smaller and the bobbin length of voice coil is shorter, and hence the recess in the diaphragm can be made deeper, so that the treble characteristic may be improved. If it is not necessary to increase the depth of the recess of diaphragm, the overall height of the speaker can be reduced accordingly, so that a compact speaker may be presented.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A speaker comprising:

a diaphragm having an outer peripheral part, a voice coil within and coupled to said diaphragm, said voice coil supported by a voice coil bobbin, said voice coil having two leads wires, a damper having an outer adhesive part and a central part between the outer adhesive part, and said voice coil bobbin, a generally cup shaped frame defining a fixed inside space and an outside space, said diaphragm disposed in said inside space of said frame so that said outer peripheral part of the diaphragm is coupled to said frame, said damper disposed in said inside space of said cup shaped frame so that said outer adhesive part of the damper is adhered to said frame, an electric relay terminal coupled to said lead wires of said voice coil, a terminal base coupled to said frame, at least two electric connection terminals coupled to said terminal base, one end of each electric connection terminal projects inside said inside space of the cup shaped frame and coupled to said electric relay terminal at a position above the central part of the damper; and said lead wires extend the shortest distance between said voice coil and said electric connection terminals projecting inside said inside space of said frame so that low frequency resonance is avoided when said speaker is in use.

2. A speaker of claim 1, wherein the electric relay terminal and electric connection terminals have mutually fitting and coupling parts.

3. A speaker comprising:

a diaphragm having an outer peripheral part, a voice coil within and coupled to said diaphragm, said voice coil supported by a voice coil bobbin, said voice coil having two leads wires, a damper having an outer adhesive part and a central part between the outer adhesive part, and said voice coil bobbin, a generally cup shaped frame defining a fixed inside space and an outside space, said diaphragm disposed in said inside space of said frame so that said outer peripheral part of the diaphragm is coupled to said frame, said damper disposed in said inside space of said cup shaped frame so that said outer adhesive part of the damper is adhered to said frame, a terminal base coupled to said frame, at least two electric connection terminals coupled to said terminal base, so that at least a portion of an end of each terminal projects inside the inside space of said cup shaped frame, wherein each one of said two lead wires is coupled to a respective one of said electric connection terminals at a location above the central part of the damper; and said lead wires extend the shortest distance between said voice coil and said electric connection terminals projecting inside said inside space of said cup shaped frame so that low frequency resonance is avoided when said speaker is in use.

4. A speaker comprising:

a diaphragm having an outer peripheral part; a voice coil within and coupled to said diaphragm, said voice coil supported by a voice coil bobbin, said voice coil having two leads wires;

a damper having an outer adhesive part and a central part between the outer adhesive part and said voice coil bobbin;

a generally cup shaped frame defining a fixed inside space and an outside space, said frame having a front surface and a flat portion within the cup shaped frame nearly parallel to the front surface; at least one terminal base fixing aperture in said flat portion;

said diaphragm disposed in said inside space of said cup shaped frame so that said outer peripheral part of the diaphragm is coupled to an edge portion of the front surface of the frame;

said damper disposed in said inside space of said cup shaped frame so that said outer adhesive part of the damper is adhered to said frame;

a terminal base fixed to said flat portion of the frame, said terminal base having at least one protrusion which is inserted into said terminal based fixing aperture of the frame for positioning the terminal base;

at least two electric connection terminals fixed to said terminal base, one end of each electric connection terminal projecting inside said inside space of the cup shaped frame and coupled to said lead wire of the voice coil at a position above the central part of the damper; and said lead wires extend the shortest distance between said voice coil and said electric connection terminals so that low frequency resonance is avoided when the speaker is in use.

5. A speaker according to claim 4, wherein a mounting groove is disposed at least partially surrounding said protrusion of the terminal base, said mounting groove having a width equal to the thickness of the frame, the frame having at least one tool aperture in the flat portion of the frame adjacent the terminal base fixing aperture, and a slender portion formed at the flat portion of the frame between said terminal base fixing aperture and said tool aperture, wherein said slender portion is deformed to a desirable shape by a tool inserted into the tool aperture.

6. The speaker of claim 5, wherein said at least one tool aperture has a semicircular shape.

7. The speaker of claim 5, wherein the deformed slender portion pushes the protrusion of the terminal base so that the mounting groove engages the frame for fixing the terminal base to the frame.

* * * * *